US005170971A

United States Patent [19]

Schaeffer et al.

[11] Patent Number: 5,170,971

[45] Date of Patent: Dec. 15, 1992

[54] TABLE TOP MOUNTABLE WRIST SUPPORTER

[75] Inventors: George Schaeffer, Encino; Alan Tom, Thousand Oaks, both of Calif.

[73] Assignee: OPI Products, Inc., North Hollywood, Calif.

[21] Appl. No.: 705,752

[22] Filed: May 28, 1991

[51] Int. Cl.[5] ..... B43L 15/00

[52] U.S. Cl. ..... 248/118.1; 248/345.1

[58] Field of Search ..... 248/118, 118.1, 118.5, 248/345.1, 615, 205.2, 911, 912; 297/411, 412

[56] References Cited

U.S. PATENT DOCUMENTS

| | | | |
|---|---|---|---|
| 2,626,163 | 1/1953 | Scantlebury | 248/118 X |
| 3.300,250 | 1/1967 | Dollgener et al. | 297/411 X |
| 3,915,528 | 10/1975 | Glickman | 248/345.1 X |
| 4,545,554 | 10/1985 | Latino et al. | 248/118.1 |
| 4.621,781 | 11/1986 | Springer | 248/118 |
| 4.817,902 | 4/1989 | Mason | 248/345.1 |
| 4,903,686 | 2/1990 | Jennings | 248/345.1 X |
| 4,920,896 | 5/1990 | Holden | 248/345.1 X |
| 4,938,439 | 7/1990 | Fried et al. | 248/118.5 |
| 4,982,921 | 1/1991 | Sanders | 248/118 |
| 5,040,757 | 8/1991 | Benaway | 248/118.3 |

FOREIGN PATENT DOCUMENTS

| | | | |
|---|---|---|---|
| 885140 | 7/1949 | Fed. Rep. of Germany | 248/345.1 |

*Primary Examiner*—Karen J. Chotkowski

*Attorney, Agent, or Firm*—Blakely, Sokoloff, Taylor & Zafman

[57] ABSTRACT

A wrist supporter made of polyurethane foam formed into a polyhedron having an L-shape cross-section adapted for installation on an edge of a work surface. In particular, two interior faces of the wrist supporter engage the top and side of the table or work surface. Hook and pile fasteners are provided on one of the interior faces for attachment to the work surface, either on top of the work surface or on the side. Thus, a flat surface incorporated into the contours of the wrist supporter can be disposed facing up or out sideways.

11 Claims, 2 Drawing Sheets

FIG. 4
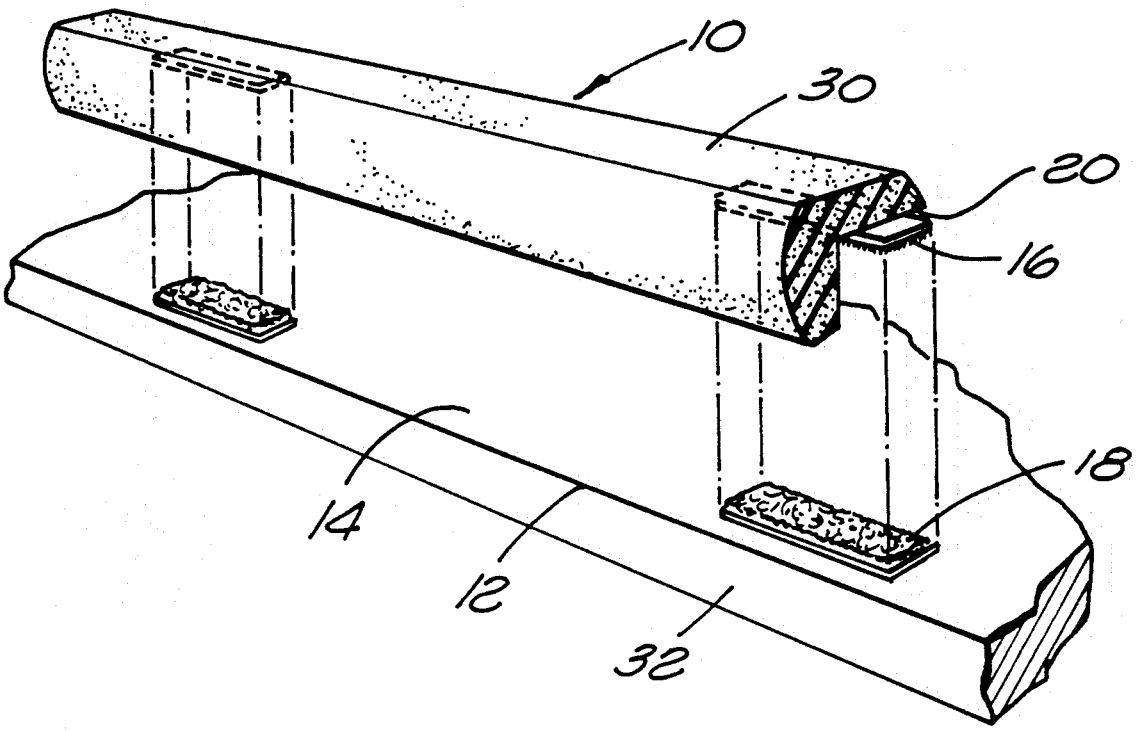
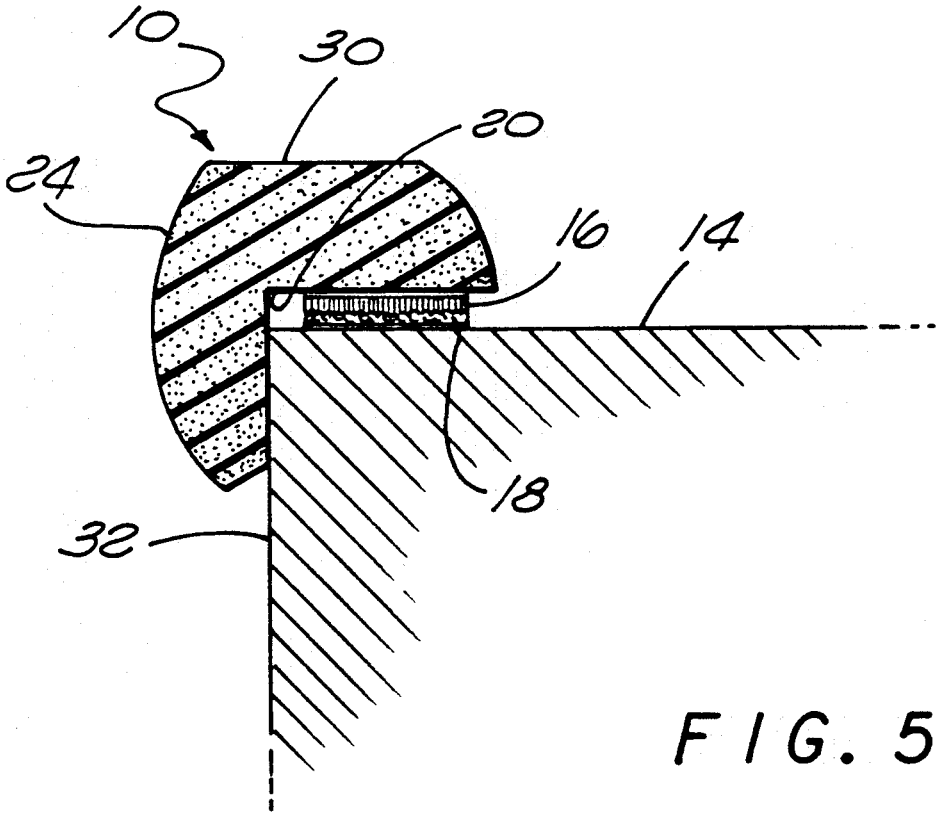
FIG. 5

TABLE TOP MOUNTABLE WRIST SUPPORTER

BACKGROUND OF THE INVENTION

1. Field of the Invention

The present invention relates to an appendage rest. More precisely, the present invention relates to a wrist or forearm supporter adapted for installation on a working surface edge.

2. Description of the Prior Art and Related Information

In recent years, personal computers, CRT terminals, electronic typewriters, joysticks for video games, computers that use a mouse, and other keyboard entry devices have proliferated in the work place as well as at home. These electronic devices require furniture specifically configured for their use. Unfortunately, furniture design has not kept up with the advances in electronics.

For example, a personal computer if placed on a conventional desk would locate the keyboard or mouse too high for a user to comfortably operate. Also, the desk edge usually has a sharp corner which tends to cut into the forearm of the user while he works. The same problems apply to CRT terminals that rely on keyboards, or even a video game that operates through a joystick for control. Indeed, most furniture are not ergonomically designed for use with keyboards and like devices.

Since many users such as computer programmers and data entry clerks work on a keyboard for extended hours, the keyboard has to be oriented such that the user remains comfortable. But as already mentioned before, most furniture are not designed for use with keyboards and the like. The result is on-the-job injuries including tendinitis or carpal tunnel syndrome caused by repeatedly typing for long periods of time in an awkward position.

There have been efforts to remedy the situation. For example, U.S. Pat. No. 4,973,176 to Dietrich discloses an appendage rest adapted for use with computer keyboards and typewriters. The appendage rest is made from a soft pad supported by legs or rollers. In use, a person working on a keyboard would rest his palm on the pad, which would elevate his hand to about the same level as the keypad of the keyboard. This would minimize the awkward positional relation between the user's hands and the keyboard. Similarly, a hand and digit exerciser disclosed in U.S. Pat. No. 4,840,370 to Biddlecombe is actually a padded cushion that could be used as described in Dietrich.

Of course many types of appendage rests exist in the art, even though they might not be specifically directed for use with computer hardware. For instance, U.S. Pat. No. 1,962,508 to Josselyn describes an arm rest which can be mounted to an automobile door. The arm rest comprises a pad of resilient material such as sponge rubber upon which a driver's arm is supported. A variety of expandable claw mechanisms, clamps, or fasteners are used to secure the pad onto the automobile door.

U.S. Pat. No. 2,478,497 to Morrison teaches a foot rest. The foot rest is shaped with a pocket configured in the shape of a person's foot. Padding is used to cover the wooden frame of the foot rest.

The idea for an appendage rest has found its way to some specialized professions. For example, U.S. Pat. No. 4,915,331 to Becker et al. discloses a palm support pedestal for elevating a person's hand in repose for undergoing a manicure treatment. The pedestal has a support bar on which the fingers may be rested and a cross bar on which the wrist may rest. An elastomeric pad covers the bottom of the pedestal to prevent sliding over a table top.

SUMMARY OF THE INVENTION

The present invention relates to an appendage supporter adapted for installation on a work surface. In a preferred embodiment, the appendage supporter is designed to attach to the edge of a table or desk top. The appendage or wrist supporter has a long, strip-like shape that is configured to neatly and unobtrusively fit against the edge of the desk top. In order to facilitate attachment to the edge of the desk, the present invention has a cross-section in the shape of an "L". This unique shape, if inverted, conforms the wrist supporter to the top edge of the desk.

Moreover, the present invention wrist supporter is made from a pliant material. This feature allows a person working at the desk to rest his or her arm comfortably thereon for long periods without discomfort or fatigue. In effect, the wrist supporter acts as a padded edge.

To facilitate attachment of the wrist supporter to the desk edge, hook and pile fasteners are provided on the interior surface of the wrist supporter. The hook and pile fastener is actually a strip of Velcro, as is known in the art. Using Velcro allows the wrist supporter to be detached from the desk edge when necessary for cleaning, for example.

Advantageously, the present invention can cover a large portion of the desk edge, well beyond the normal forearm reach of a person sitting at the desk. This allows a significant degree of freedom of motion for the person while still benefiting from the support provided by the present invention.

With the present invention wrist supporter in place, a person typing at the table can have his or her wrists lifted to the proper level to achieve optimal ergonomics. Work related injuries from repeated motions are minimized while productivity is improved. Naturally, the present invention may be used in many applications aside from helping keyboard users.

For example, a manicurist who spends a lot of time crouched over the edge of a table doing minute and intricate work requires an equal amount of support to avoid discomfort or more serious physical ailments. Thus, installing the wrist supporter can be beneficial to both the manicurist or her client since both persons must remain at a workbench or table for long periods of time.

In one embodiment of the present invention, the material used for the wrist supporter is polyurethane foam. It is soft to alleviate fatigue, and also eliminates marks under the forearm. If used by a manicurist, the polyurethane foam of the wrist supporter resists acetone and nail liquids. If used in an office setting, the wrist supporter is designed such that when mounted at the edge of a desk, it does not block or prevent the desk drawers from sliding in and out.

BRIEF DESCRIPTION OF THE DRAWINGS

FIG. 4 is a perspective view of an alternative embodiment of the present invention just before assembly to the table edge, wherein a flat portion of the wrist supporter and the hook and pile fasteners are disposed on the top surface of the table.

FIG. 5 is a cross-sectional view of an alternative embodiment of the present invention as mounted to a table edge with the flat portion oriented toward the top.

DETAILED DESCRIPTION OF THE INVENTION

In the following description, for purposes of explanation and not limitation, specific numbers, dimensions, materials, etc. are set forth in order to provide a thorough understanding of the present invention. It is apparent to one skilled in the art, however, that the present invention may be practiced in other embodiments that depart from the specific embodiments detailed below.

Figure 1:
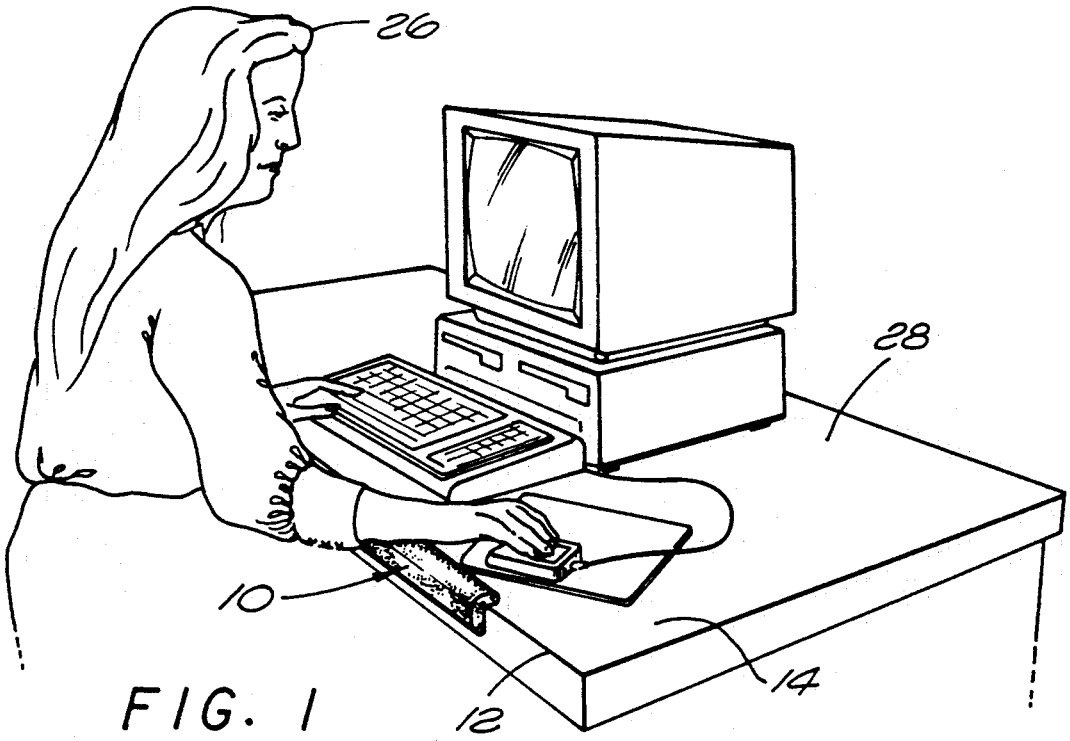
FIG. 1 is a perspective view of the present invention wrist supporter as affixed to a table edge.

The present invention relates to an appendage or wrist supporter. As shown in FIG. 1, an embodiment of the present invention wrist supporter 10 is mounted to a table edge 12. A user 26 is shown sitting at a work station in front of a keyboard-operated computer. Without the wrist supporter 10 in position, the user 26 would have to rest her forearm or wrist directly on the table edge 12. It should be apparent that the upper body weight of the user 26 is supported by her forearms pushing against the table top 14. Indeed, the natural tendency is for the user 26 to lean forward toward the keyboard and computer screen. Thus, the sharp table edge 12 cuts into the exposed flesh of the forearm or wrist. But with the wrist supporter 10 in place, the discomfort caused by the sharp edge 12 of the table is dissipated by the compliance of the wrist supporter 10. In this embodiment, the wrist supporter 10 is made from polyurethane foam to insure suppleness. Foam rubber may also be used, as well as many other suitable materials known in the art.

Also worth noting in FIG. 1 is the unique shape of the wrist supporter 10. In particular, the cross-section of the wrist supporter 10 is shaped like an L. This allows the wrist supporter to wrap around the edge 12 of the table top 14. The length of the wrist supporter 10 also permits great freedom of movement for the user 26 since the wrist supporter 10 guards a significant portion of the table edge 12.

Figure 2:
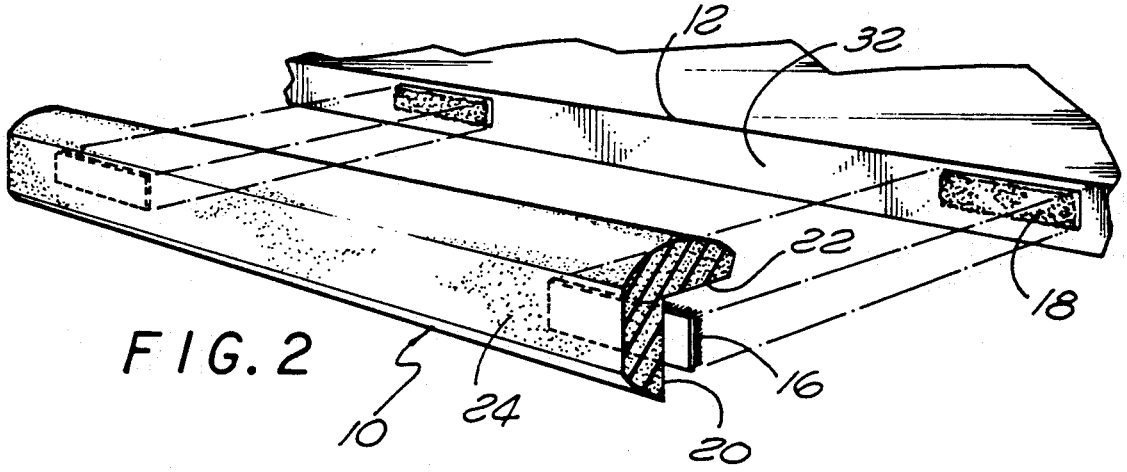
FIG. 2 is a perspective view of the present invention just before assembly to the table edge, wherein a flat portion of the wrist supporter and the hook and pile fasteners are disposed on the side of the table.

FIG. 2 shows the wrist supporter 10 before assembly to the table edge 12. From this angle, the overall shape of the wrist supporter 10 can be clearly discerned. The wrist supporter 10 is described generally as a polyhedron having a number of polygonal faces. The polyhedron is generally long and narrow in shape so as to substantially cover the table edge 12. From a cross-sectional view, the polyhedron that makes up the wrist supporter 10 has an L-shape. The L-shape profile when inverted fits neatly against the 90° bend of the table edge 12. An interior angle of the L-shape polyhedron is formed by a first adjacent face 20 that intersects at a substantially right angle with a second adjacent face 22. The interior of the L then, as shown in FIG. 2, mounts against the table edge 12. The exterior face 24 of the L is generally arcuate in shape as seen from its slight convex curvature.

Figure 3:
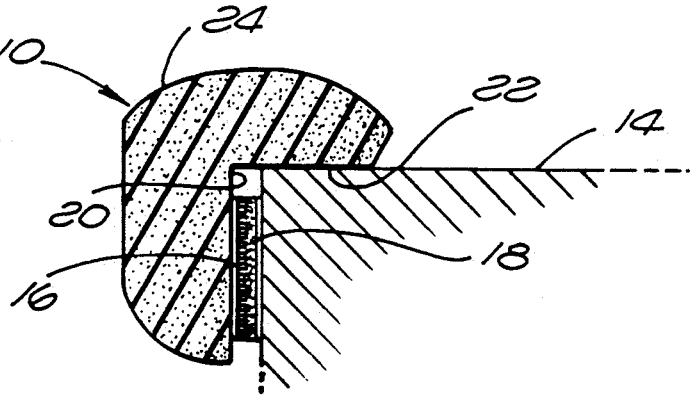
FIG. 3 is a cross-sectional view of the present invention as mounted to a table edge with the flat portion oriented toward the side.

FIG. 3 provides a sectional view of the wrist supporter 10, which clearly conjures up an image of an inverted L. With the wrist supporter 10 installed, as shown here, the second adjacent face 22 rests flush against the table top 14. Similarly, the first adjacent face, which forms an approximate 90° interior angle with the second adjacent face 22, is disposed substantially parallel to the side of the table. Quite noticeable here is a flat surface 30 integrated into the convex exterior face 24. The purpose of the flat surface 30 is to truncate the exterior face 24 so that the wrist supporter 10 does not interfere with access to drawers that might be situated just underneath the table top 14. The flat surface 30 is formed generally parallel to the first adjacent face 20.

A hook and pile fastener is used to attach the wrist supporter 10 to the side 32 of the table 28. In one embodiment of the present invention, the hook and pile fastener corresponds to a Velcro strip, well-known in the art. The Velcro strip has a hook component 16 and a complimentary pile component 18. When either the hook component 16 or pile component 18 is affixed to the table side 32, and the counterpart component is affixed to the first adjacent face 20 of the wrist supporter 10, the latter can be detachably attached to the table 28. Since the operation of a Velcro strip is well-known in the art, no discussion is required here. Of course, other means of fastening the wrist supporter 10 to the table side 32 are possible. The benefit of Velcro strips is that the wrist supporter 10 may be easily detached from the table 28 when needed for cleaning, or furniture housekeeping and re-attached thereafter. FIG. 3 shows the wrist supporter 10 assembled to the table side 32, with the two Velcro components 16 and 18 pressed and locked together.

In an alternative embodiment, shown in FIGS. 4 and 5, the present invention may be mounted so that the hook and pile fastener is attached to the table top 14 instead of the table side 32. In this orientation, the hook and pile fasteners would connect the first adjacent face 20 to the table top 14, rather than connecting the first adjacent face 20 to the table side 32. Indeed, regardless of whether the hook and pile fastener is attached to the table side 32 or table top 14, the wrist supporter 10 may be oriented either with its flat surface 30 parallel to the table side 32 or table top 14. Depending upon orientation of the wrist supporter and the resultant positioning of the flat surface 30 and the convex exterior face 24, a different contour surface is provided for support to the forearm.

What is claimed is:

1. A wrist supporter mounted to a work surface having a top surface and a side surface comprising:

a one-piece polyhedron made of a pliant material having a generally L-shape cross-section wherein first and second inside faces of the polyhedron form a substantially right angle that defines an interior of the L, one outside face having a rounded convex shape generally opposite the first inside face and another outside face having a flat surface generally opposite the second inside face and said top and front surfaces of said work surface being at a substantially right angle and said first and second inside faces of said wrist supporter being attached said top and front surfaces; and means for fastening the wrist supporter to the work surface mounted to the interior of the L.

2. A wrist supporter according to claim 1, wherein the means for fastening is a hook and pile fastener.

3. A wrist supporter according to claim 2, wherein the hook and pile fastener is Velcro.

4. A wrist supporter according to claim 3, wherein the pliant material is polyurethane foam.

5. A wrist supporter according to claim 3, wherein the pliant material is foam rubber.

6. A wrist supporter according to claim 3, wherein the convex exterior face further incorporates a flat surface therein.

7. A wrist supporter according to claim 6, wherein the flat surface is oriented on top of the work surface.

8. A wrist supporter according to claim 6, wherein the flat surface is oriented on a side of the work surface.

9. A wrist supporter according to claim 1, wherein the means for fastening is disposed on top of the work surface.

10. A wrist supporter according to claim 1, wherein the means for fastening is disposed on a side of the work surface.

11. A wrist support mounted to a support surface comprising:

a polyhedron made of a pliant material having an L-shape cross-section wherein first and second inside faces of the polyhedron form a substantially right angle to define an interior of the L;

the L-shape cross-section having a rounded convex exterior face generally opposite the first inside face and a flat exterior face generally opposite the second inside face, and meeting which intersect to define an exterior of the L;

the support surface having an edge defined by a substantially perpendicular intersection of two planar faces, said planar surfaces being the top and front surfaces of said support surface, and wherein the inside faces of the wrist support are attached to the top and front surfaces of said support surface;

means for mounting the wrist support to the edge of the support surface having a female portion adapted to receive a corresponding male portion, one of the portions positioned on at least one of the interior faces of the wrist support and the other of the portions respectively positioned on at least one of the planar faces of the support surface; and the exterior faces of the wrist support reversible with respect to the substantially perpendicular planar faces of the support surface to provide a different level of support and a different contour.

* * * * *